US005197530A

United States Patent [19]

Vatant et al.

[11] Patent Number: 5,197,530

[45] Date of Patent: Mar. 30, 1993

[54] METHOD AND APPARATUS FOR PRESSURE CASTING FLAT METAL PRODUCTS

[75] Inventors: Robert A. Vatant, Saint-Chamond; Michel F. Corubier, LeBreuil, both of France

[73] Assignee: Cruesot-Loire Industrie and Clecim, Puteaux and Cergy Pontoise, France

[21] Appl. No.: 721,579

[22] PCT Filed: Jan. 16, 1990

[86] PCT No.: PCT/FR90/00034

§ 371 Date: Sep. 10, 1991

§ 102(e) Date: Sep. 10, 1991

[87] PCT Pub. No.: WO90/07996

PCT Pub. Date: Jul. 26, 1990

[30] Foreign Application Priority Data

Jan. 16, 1989 [FR] France ..... 89 00457

[51] Int. Cl.[5] ..... B22D 18/04

[52] U.S. Cl. ..... 164/119; 164/137; 164/306; 164/339; 164/342

[58] Field of Search ..... 164/119, 126, 128, 137, 164/306, 309, 348, 339, 342; 249/79, 80

[56] References Cited

U.S. PATENT DOCUMENTS

| | | | |
|---|---|---|---|
| 3,163,887 | 1/1965 | Schultz | 164/284 X |
| 3,459,256 | 8/1969 | Jeffreys . | |
| 3,590,904 | 7/1971 | Woodburn, Jr. . | |
| 3,701,377 | 10/1972 | Fisher | 164/137 X |
| 4,733,714 | 3/1988 | Smith | 164/119 X |

FOREIGN PATENT DOCUMENTS

| | | | |
|---|---|---|---|
| 2140268 | 2/1973 | Fed. Rep. of Germany . | |
| 793715 | 1/1981 | U.S.S.R. | 164/306 |

*Primary Examiner*—J. Reed Batten, Jr.
*Attorney, Agent, or Firm*—Cushman, Darby & Cushman

[57] ABSTRACT

Flat metal products are pressure cast in a mould having two lateral walls each consisting of a support and of a graphite block as well as several spacers, including an upper spacer interposed between the blocks. The ends of the upper spacer and of the front spacer are inserted between two half-shells intended to receive a header of molten metal at the end of the cast. Elastic members carried by the supports exert during the cast, a clamping force of the half-sheels on the spacers. After the start of solidification of the slab, the clamping force is reduced by lateral jacks which eliminate any resistance to contraction of the slab and thus prevent the formation of cracks at the slab/header transition.

4 Claims, 3 Drawing Sheets

70
1
4
11
2
10
15
22
20b
12
61
25
51
20
21
40
7
23
8
27
5
6
17

METHOD AND APPARATUS FOR PRESSURE CASTING FLAT METAL PRODUCTS

The present invention relates to a method for pressure casting flat metal products, such as slabs, from a ladle of molten metal.

In a manner known per se, the molten metal contained in this ladle is cast, by means of the pressure of compressed air, into a mould comprising two lateral walls equipped with graphite blocks and spacers delimiting a cavity for receiving the molten metal and two half-shells which are open towards the top and towards the bottom, which are complementary and placed above a shaft. The latter is delimited by a front spacer, that is to say located on the side via which the molten metal penetrates into the mould, and by an end of an upper spacer and forms an access for the molten metal to the inside of the hollow volume of the half-shells in order to form therein a header of molten metal.

In pressure casting, the header plays an important role insofar as it participates, to a large extent, in the result, that is to say in the quality of the slab. The role of this header is essentially to form a reservoir of molten steel which refeeds the slab during shrinkage and cooling thereof between the graphite blocks and the spacers. The header forms a mass of steel which is sufficient, after the end of the cast and the solidification of the bath, to control the virtually inevitable shrinkage connected with casts in moulds, in order that this should not affect the final product.

Another function of the header is to leave contraction of the slab free, during cooling, in order to avoid the cracks which inevitably appear when blocking is too rigid. To this end, the mould of the header consists of the abovementioned two half-shells, generally made from cast iron, which are pressed, on the one hand, on the front spacer and, on the other hand, on the upper spacer through the action of elastic clamping members placed on each side of the half-shells.

The force of application of the half-shells on the spacers must be much greater than the ferrostatic force in order to guarantee no leakage of the molten metal. However, this force, which is essential to combat the infiltrations of steel which would arise in the event of poor clamping, opposes the free shrinkage of the molten steel in the header via the base of the shaft towards the actual slab and this opposition is detrimental to the quality of the slab obtained. In fact, the clamping force exerted by the elastic members on the half-shells interferes with the shrinkage of the slab via the base of the shaft towards the cavity contained between the graphite blocks. Thus, if the clamping force of the half-shells is greater than the force of which the skin of the molten metal during solidification is capable, major cracks inevitably appear at the transition between the actual slab and the header.

The invention aims to propose a method and a device for implementing the latter which eliminate the abovementioned drawbacks.

According to the invention, the pressure-casting method is characterized in that, during the cast of the molten metal in the half-shells and the start of its solidification, a high clamping force of the half-shells is maintained and then, when the surface skin of the header is sufficiently solidified, the clamping force is reduced in order to eliminate any resistance to the contraction of the flat product.

Under these conditions, the walls of the half-shells offer less resistance to the shrinkage of the slab after reduction of the clamping force. Thus, virtually no further notable cracking is observed at the slab/header transition.

According to the invention, the device for implementing this method comprises, on each side of the half-shells, means for substantially reducing the clamping force of the elastic members after the cast and at the beginning of the solidification of the molten metal.

According to one embodiment of the device, the abovementioned means comprise, for each half-shell, a jack articulated on the latter and carried by a fixed part of the mould so that it is possible to exert, on the associated half-shell, a transverse traction force opposed to the clamping force of the elastic members.

Other features and advantages of the invention will become apparent during the following description which is given with reference to the appended drawings which illustrate an embodiment thereof by way of non-limiting example.

Figure 1:
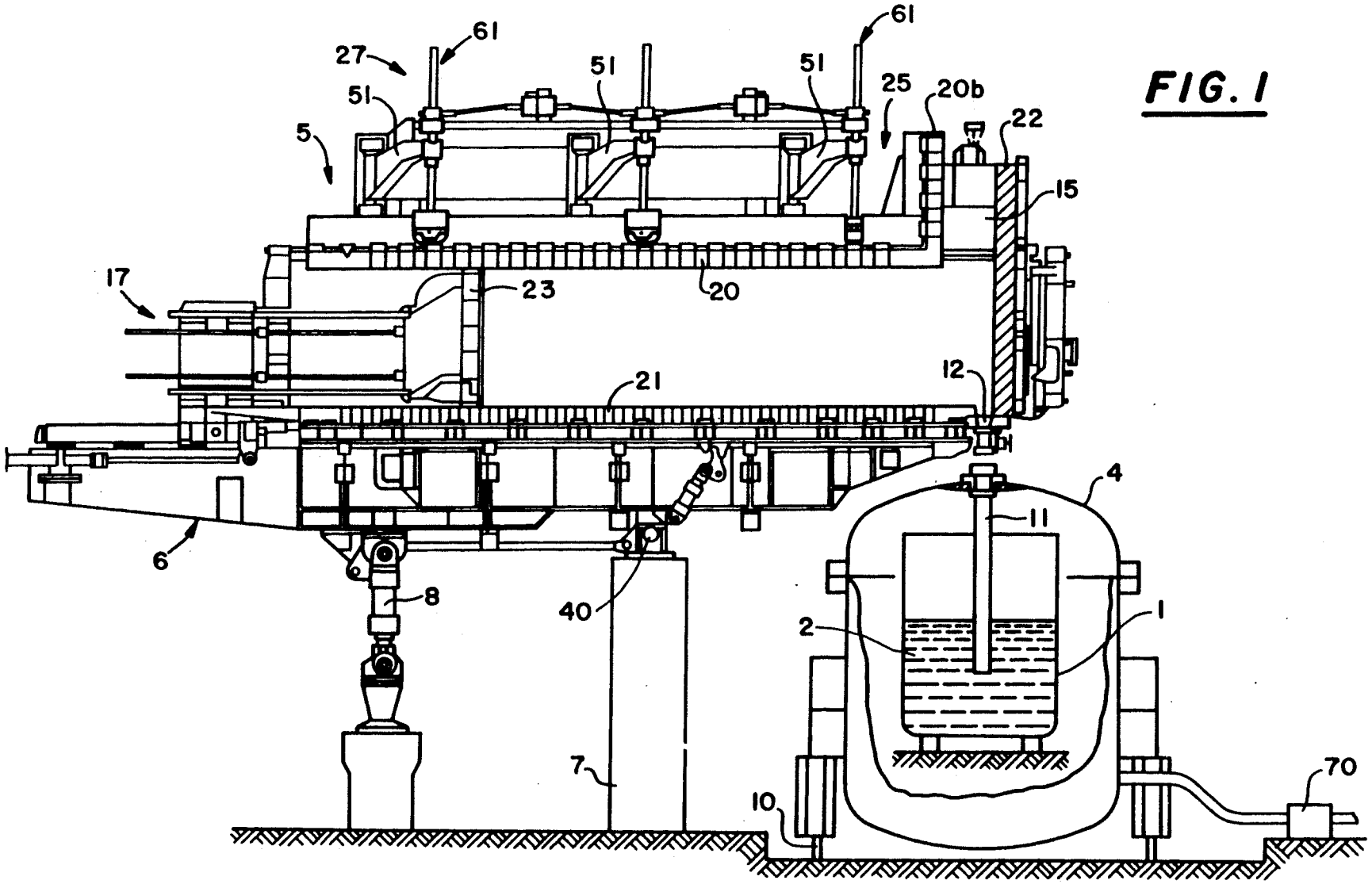
FIG. 1 is a view in longitudinal section, according to a vertical median plane, and in partial elevation of a mould for pressure casting flat metal products which can be equipped with a shell, not shown, for forming the header of the slab.

The pressure-casting installation to which the invention relates comprises (FIGS. 1 and 2) a ladle 1 of molten metal 2 disposed in a vessel 4 supported by a carriage 10, and a mould 5 resting on a frame 6 which is itself supported by columns 7 and by a hydraulic jack 8.

The vessel 4 is equipped with a leaktight cover 9 through which passes a refractory tube 11 whose lower end is immersed in the molten metal 2. The upper end of the tube 11 passes through the cover 9 at the level of a device which is known per se and which makes it possible to ensure a leaktight join between an opening 12 for filling the mould 5 and the tube 11. An apparatus 70 makes it possible to convey, inside the ladle 1, compressed air at a suitable pressure, which forces the molten metal 2 into the tube 11 in order to cause it to penetrate inside the mould 5 in order to cast the desired flat metal product therein.

In FIG. 1, the assembly consisting of the mould 5 and its support frame 6 is shown horizontal. The jack 8 makes it possible to tilt the frame 6 and the mould 5 on the columns 7 about a horizontal shaft 40 which is transverse to the plane of the figure and which forms the articulation of this assembly on the columns 7. This tilting makes it possible to slightly incline the mould 5 in order to bring it into its position which permits casting of the molten metal 2, in a manner known per se.

The mould 5 comprises two parallel lateral walls 25 each consisting of a support 30 and of a graphite block 31 which is partially housed in the support 30 forming the graphite-holder frame.

In the example shown, the support frame 30 has a C- or a U-shaped cross-section, the upper and lower branches of which together partially surround the corresponding block 31.

The blocks 31 are pierced by channels 33 (FIG. 2) which make it possible to receive systems for cooling the blocks 31 by spraying water.

The mould 5 also comprises, disposed between the opposite inner faces 32 of the two blocks 31, four spacers (20, 21, 22, 23) interposed between the blocks 31 which are held clamped on these spacers during casting of the molten metal by means which are not shown (jacks and elastic devices disposed laterally to the walls 25), in order to prevent any leakage of molten metal outside the spacers during the cast. These means for clamping the walls 25 on the spacers and for transverse displacement of the latter are described in U.S. patent application No. 07/720,778 filed on the same day as the present application and now U.S. Pat. No. 5,143,145. The description of these clamping means and of other component parts of the casting installation in FIG. 1 is given in detail in that patent application and does not concern the present invention.

A description is thus given here only of those elements of the installation which are of use for understanding the invention.

The mould 5 comprises the following spacers:

a longitudinal lower spacer 21, extending substantially over the entire length of the walls 25 and bearing on the central part of the frame 6.

a front spacer 22 which is substantially vertical when the mould 5 is placed in a horizontal position (FIG. 1) and whose lower end delimits, with the adjacent end of the lower spacer 21, the orifice 12 for the molten metal to enter into the cavity forming the mould 5 between the blocks 31.

a rear spacer 23 perpendicular to the lower spacer 21, over which it can be displaced in a sliding manner by a drive device 17 supported by the frame 6.

an upper spacer 20 located slightly below the upper edge of the blocks 31, parallel to the spacer 21. The upper spacer 20 is disposed above the lower spacer 21 at a height equal to that of the rear spacer 23 and which corresponds to the width of the flat product to be cast. The spacers 20 to 23 all have the same thickness, which determines the thickness of the flat product.

The position of the rear spacer 23 in the longitudinal direction, regulated by the device 17, determines the length of the flat product to be cast.

The upper spacer 20 is carried by a suspension device 27 which is itself supported by a longitudinal beam which is not visible in the drawings. This suspension device 27 is described in detail in U.S. patent application No. 07/720,864 filed on the same day as the present application and entitled "Device for supporting and regulating the position of an upper spacer of a pressure-casting mould". This description is not of interest for the present invention. It will thus be indicated simply that the suspension device 27 comprises several levers 51 mounted so as to pivot about shafts carried by the abovementioned beam and that each lever 51 carries a screw jack 61 at its end, the upper spacer 20 being suspended from the screw jacks 61.

Figure 2:
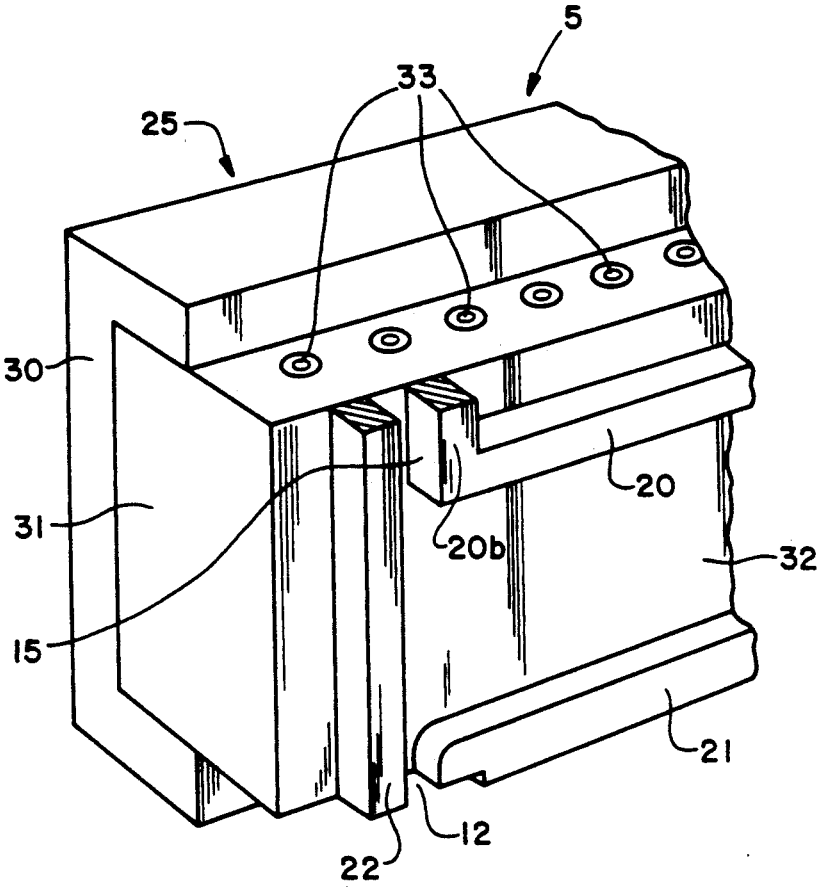
FIG. 2 is a partial perspective view of the mould in FIG. 1.

A description will now be given, more particularly, of the part of the pressure-casting installation in FIGS. 1 and 2 referred to by the invention.

Figure 4:
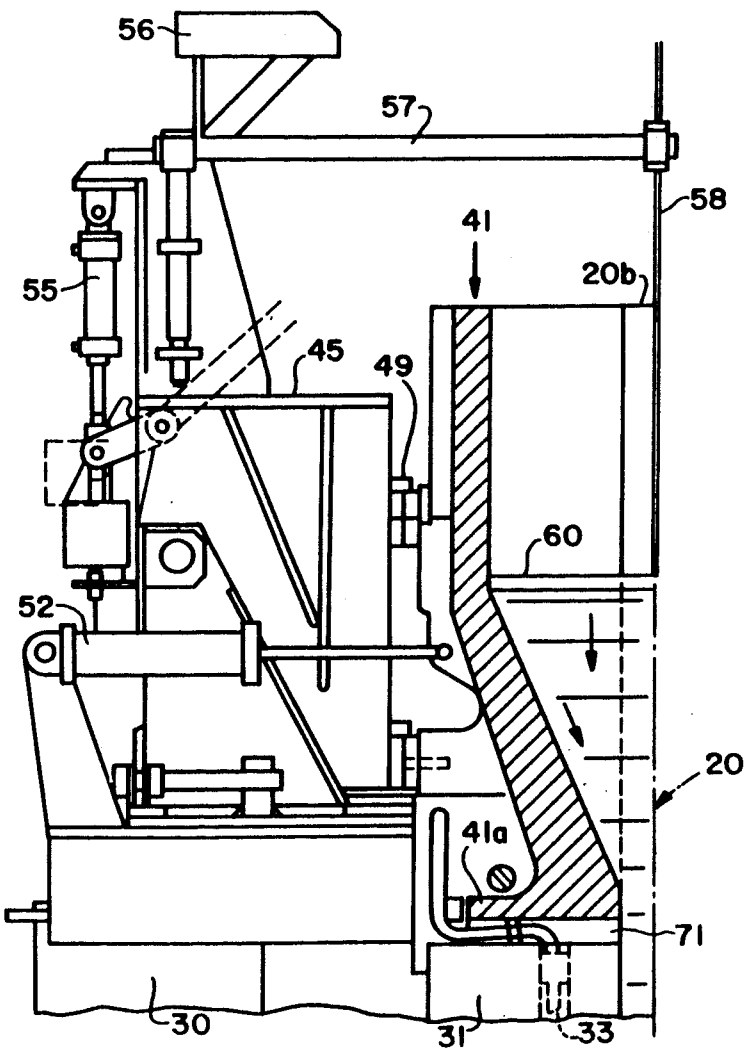
FIG. 4 is a half-sectional half-elevation view, similar to FIG. 3, of the second half-shell which complements that in FIG. 3.
Figure 3:
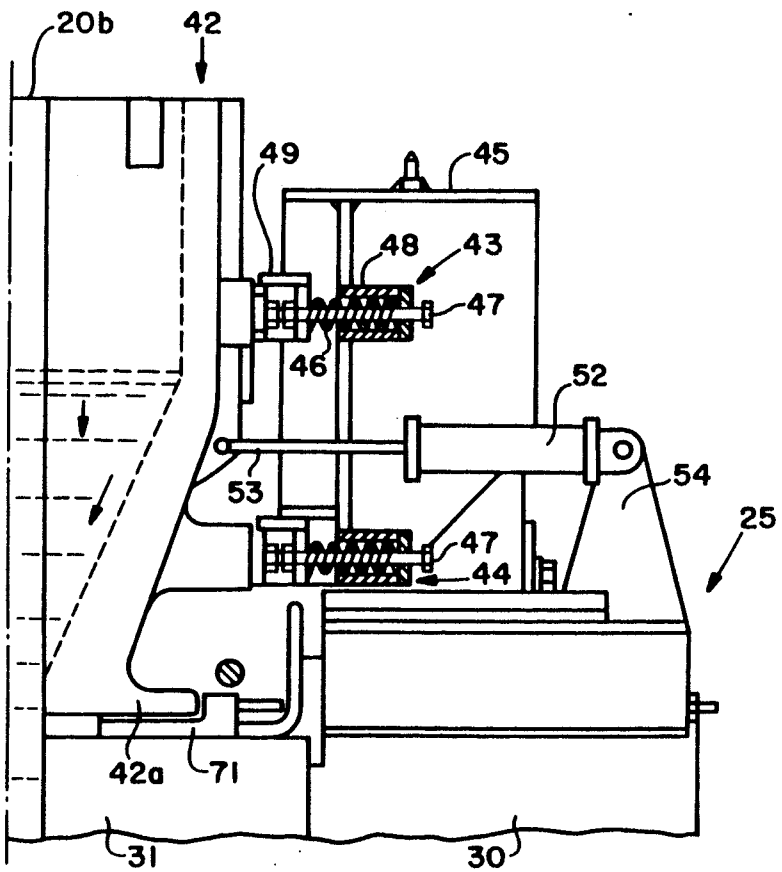
FIG. 3 is a view in elevation, in a plane perpendicular to the longitudinal vertical median plane in FIG. 1, of one of the half-shells which can equip the mould in FIG. 1 and which is provided with a clamping device according to the invention.

The upper spacer 20 comprises, opposite the upper end of the front spacer 22, an end part 20*b* bent upwards at a right angle. This bent part 20*b* extends vertically upwards over a certain height, like the upper end of the spacer 22 with which it delimits a riser 15 in which the cast metal can penetrate when filling of the mould 5 is completed. This channel 15 places the inner volume of the mould 5 in communication with a shell, shown in FIGS. 3 and 4, formed by two complementary half-shells 41 and 42 which are open towards the top and towards the bottom and together delimit, at their base, an opening for introducing the molten metal. Each half-shell 41, 42 rests on the end of a graphite block 31. This shell 41, 42 may be partially filled at the end of casting by a header 60 of molten metal in which, after solidification of the slab, a shrinkage hole may be produced.

The two half-shells 41 and 42 are held pressed against the upper end part 20*b* of the spacer 20 and against the upper end of the front spacer 22, so that molten metal does not leak out, by elastic clamping members. In the example described, the latter are two in number 43 and 44 and are each associated with a corresponding half-shell 41, 42. Each pair of clamping members 43, 44 is housed in a casing 45 carried by the support 30 of the corresponding lateral wall 25. Each clamping member 43, 44 comprises a helical spring 46 placed coaxially about a rod 47 disposed in a cylinder 48 attached to the casing 45 which is itself fixed to the support 30. Each rod 47 passes through the bottom of the corresponding cylinder 48 through which it can slide in a direction perpendicular to the vertical longitudinal median plane of the shell 41, 42 and of the mould 5. Each spring 46 bears on the fixed bottom of the cylinder 48 in which it is held in place about the rod 47, while its opposite end bears on a lateral lug 49 of the associated half-shell 42 or 41, on which is thus exerted a transverse clamping force against the spacers 20 and 22, after suitable calibration of the springs 46.

The bases 41*a*, 42*a* of the half-shells 41 and 42 rest, with slight lateral play, on the linings 71 fixed on blocks 31, in order to permit a slight transverse spacing of the half-shells 41, 42.

Each half-shell 41 and 42 is associated with a jack 52 (hydraulic or pneumatic) mounted so that its rod 53 can exert, on the corresponding half-shell 41, 42, a transverse force in a direction parallel to that of the forces exerted by the elastic members 43 and 44. Each rod 53 is thus articulated on the associated half-shell 41, 42, while the body of the jack 52 is carried by a fixed part of the mould 5, for example, as shown, the corresponding support 30 of a lateral wall 25. Each body of a jack 52 is in this case articulated on a plate 54 fixed to the upper part of the support 30, the jack being disposed in a direction which is substantially horizontal and perpendicular to the vertical longitudinal median plane of the mould 5 and of the shell 41, 42 and, preferably, at a height such that it is interposed between the clamping members 43 and 44.

A jack 55 mounted on one of the casings 45 (FIG. 4) makes it possible to maneuver a container 56 which contains a powder for covering the bath 60 of steel.

A crosspiece 57 carries, at its end, a vertical rod 58 which is immersed in the shell 41, 42. Contact between its lower end and the bath 60 corresponds to the end of the cast in the mould 5 and triggers an electrical contact, in a known manner.

Operation of the clamping device of the half-shells 41, 42, which has just been described, is as follows, according to the method referred to by the invention.

During casting of the molten metal 2 in the half-shells 41, 42 and the start of its solidification, a high clamping force of the half-shells 41, 42 is maintained by the elastic members 43, 44, whereas the two jacks 52 are totally "relaxed" and thus themselves do not exert any force on the half-shells 41 and 42.

When the surface skin of the header of molten steel contained in the shell 41, 42 is sufficiently solidified, the clamping force of the elastic members 43 and 44 is slightly reduced by triggering the jacks 52 so that they exert, on the associated half-shells 41, 42, traction forces which are opposed to the clamping forces of the devices 43, 44. These forces are thus similarly reduced.

The force of the jacks 52 is regulated to a value in the vicinity of the relaxation of the springs 46 during the solidification of the molten metal. This relaxation force corresponds to the slightly reduced force of the springs 46. Thus, whereas, during the cast in the mould 5, maximum clamping of the half-shells 41, 42 against the spacers 20, 22 guarantees leaktightness, the slight reduction of the transverse clamping force after the start of the solidification makes it possible to maintain the necessary leaktightness. The force exerted by the jacks 52 is thus regulated so as, in fact, to permit firm static support of the solidified surface layer of the header 60, while virtually eliminating the shrinkage forces in the slab, which guarantees that cracks will not appear at the slab/-header transition.

Figure 5:
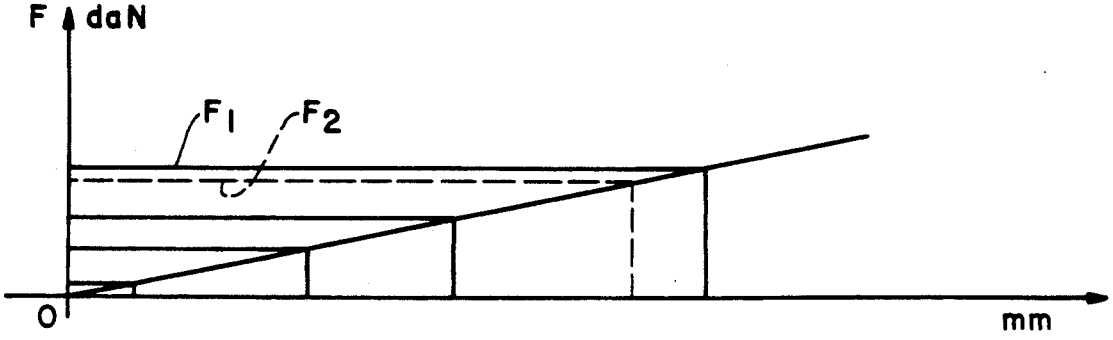
FIG. 5 is a diagram representing the clamping force of the half-shells on one another by means of the elastic clamping members, as a function of the distance between the center and end portion of the elastic members when subject to a load.

By way of non-limiting indicative example, the diagram in FIG. 5 shows the clamping force F in daN of the half-shells 41, 42 as a function of the distance, in millimeters, between the center and end portion of the clamping members 46 when submitted to a load. This value corresponds to the total force of the elastic members 43 and 44. The value Fl is the total clamping force of the elastic members 43 and 44 and the value F1–F2 is the force actually applied to the half-shells 41, 42 after triggering of the jacks 52.

The method and the means for implementing it provided by the invention make it possible to avoid the long, tricky and unreliable regulation operations which would be necessary as a function of the different slab formats and of the various heights of headers required in the various cases. The height of the header varies essentially as a function of the volume of steel cast, on the insulation of the shell of the header and, if appropriate, on the grade of steel cast.

By virtue of the invention, it is thus possible to dispense with any regulation operation other than a simple initial regulation which is carried out according to the most extreme case when using the mould 5. Relaxation of the elastic clamping members 43 and 44 by the jacks 52 is independent of the various possible configurations for the header.

The invention is capable of receiving various alternative embodiments. Thus, in particular, the elastic members 43 and 44 may be replaced by stacks of elastic washers providing, like the devices shown in FIG. 3, a perfectly reliable positive mechanical clamping during the cast. If appropriate, a single clamping member 43 or 44 could be disposed on each side of the shell.

We claim:

1. A method for pressure casting a flat metal product from a ladle of molten metal in a mould, said mould comprising:

two lateral walls including graphite blocks and spacers defining a cavity for receiving the molten metal, and two half-shells being open towards a top and a bottom surface thereof, said half-shells being supported by a portion of said graphite blocks so as to be disposed above said lateral walls, said half-shells being clamped against one another and being disposed above a channel, said channel being defined by said spacers, said channel connecting said cavity with an interior volume of said half-shells permitting access of the molten metal to the interior volume of said half-shells so as to form a header of molten metal therein, said method comprising the steps of:

introducing the molten metal into said half-shells in a casting operation so as to fill said cavity and form said header, maintaining a large clamping force on said half-shells during said casting operation and at the start of solidification of the molten metal, and reducing said clamping force when a surface skin of said heater becomes solidified so as to eliminate any resistance to contraction of said cast flat product.

2. A device for pressure casting flat metal products from a ladle of molten metal comprising:

a mould, including:

two lateral walls including graphite blocks and spacers defining a cavity for receiving the molten metal, two half-shells being joined so as to have a volume, said half-shells being supported by a portion of said graphite blocks so as to be disposed above said lateral walls, said half-shells being disposed above a channel, said channel being defined by said spacers, said channel connecting said cavity with said volume of said half-shells permitting access to said volume for receiving the molten metal for forming a header of the molten metal, at least one clamping member for clamping said half-shells together, and means for reducing the clamping force of said clamping member.

3. Device as claimed in claim 2, wherein said reducing means is provided for each half-shell, said force reducing means including:

a jack cooperatively associated with each of said half-shells and carried by a fixed part of said mould for exerting a traction force opposing the clamping force exerted by said clamping member on said half-shell.

4. Device as claimed in claim 3, wherein said jack and said clamping member are supported by frame members, said frame members carrying the graphite blocks and forming therewith, said lateral walls of the mould.

* * * * *